United States Patent [19]

Bertsch

[11] Patent Number: 4,522,704

[45] Date of Patent: Jun. 11, 1985

[54] PASSIVATION OF CRACKING CATALYSTS

[75] Inventor: Carl F. Bertsch, Baton Rouge, La.

[73] Assignee: Exxon Research & Engineering Co., Florham Park, N.J.

[21] Appl. No.: 559,891

[22] Filed: Dec. 9, 1983

[51] Int. Cl.[3] ..... C10G 11/00

[52] U.S. Cl. ..... 208/113; 208/52 CT; 502/50; 502/521

[58] Field of Search ..... 208/52 CT, 113, 120; 502/521, 50

[56] References Cited

U.S. PATENT DOCUMENTS

| | | | |
|---|---|---|---|
| 2,575,258 | 11/1951 | Corneil et al. | 502/50 |
| 2,901,419 | 8/1959 | Brill | 208/119 |
| 3,306,707 | 2/1967 | Hardison | 502/50 |
| 3,408,286 | 10/1968 | Hepp et al. | 208/120 |
| 4,169,042 | 9/1979 | McKay | 208/113 |
| 4,208,302 | 6/1980 | McKay | 502/53 |
| 4,218,337 | 8/1980 | McKay | 502/20 |
| 4,238,317 | 12/1980 | Vasalos et al. | 208/120 |
| 4,256,564 | 3/1981 | Roberts et al. | 208/120 |
| 4,257,919 | 3/1981 | Roberts et al. | 502/64 |
| 4,268,416 | 5/1981 | Stine et al. | 502/50 |
| 4,280,895 | 7/1981 | Stuntz et al. | 208/113 |
| 4,280,896 | 7/1981 | Bearden et al. | 208/113 |
| 4,280,898 | 7/1981 | Tatterson et al. | 208/119 |
| 4,298,459 | 11/1981 | Tatterson et al. | 208/120 |
| 4,334,979 | 6/1982 | Bertus et al. | 208/114 |
| 4,345,992 | 8/1982 | Washer et al. | 208/120 |
| 4,348,273 | 9/1982 | Nielsen | 208/113 |
| 4,370,220 | 1/1983 | Bearden et al. | 208/108 |
| 4,372,840 | 2/1983 | Bearden et al. | 208/113 |
| 4,372,841 | 2/1983 | Stuntz et al. | 208/113 |
| 4,377,470 | 3/1983 | Hettinger, Jr. et al. | 208/120 |
| 4,386,015 | 5/1983 | Bertus et al. | 502/60 |
| 4,409,093 | 10/1983 | Bearden et al. | 208/108 |
| 4,439,536 | 6/1981 | Bertus et al. | 502/64 |

FOREIGN PATENT DOCUMENTS

| | | | |
|---|---|---|---|
| 0038047 | 4/1981 | European Pat. Off. . | |
| 005235 | 11/1981 | European Pat. Off. . | |
| 8203225 | 3/1981 | Int'l Pat. Institute . | |
| 8203226 | 3/1981 | Int'l Pat. Institute . | |
| 8204063 | 11/1982 | Int'l Pat. Institute . | |
| WO82/03225 | 9/1982 | PCT Int'l Appl. | 208/113 |
| 2124249 | 2/1984 | United Kingdom . | |

*Primary Examiner*—Delbert E. Gantz
*Assistant Examiner*—O. Chaudhuri
*Attorney, Agent, or Firm*—Edward H. Mazer; Robert J. North

[57] ABSTRACT

A method for passivating the adverse catalytic effects of metal contaminants, such as nickel, vanadium and iron, which become deposited on cracking catalyst is disclosed. A passivation promoter selected from the group consisting of cadmium, germanium, indium, tellurium and zinc is deposited on the catalyst and the catalyst is passed through a passivation zone having a reducing atmosphere maintained at an elevated temperature to decrease the adverse catalytic effects of the metal contaminants. The present method is of particular utility where the residence time of the cracking catalyst in the passivation zone is relatively short.

17 Claims, 2 Drawing Figures

PASSIVATION OF CRACKING CATALYSTS

BACKGROUND OF THE INVENTION

The present invention is directed at a process for catalytic cracking of hydrocarbon feedstocks. More specifically, the present invention is directed at a method for reducing the detrimental effects of metal contaminants such as nickel, vanadium and/or iron, which typically are present in the hydrocarbon feedstock processed and are deposited on the cracking catalyst.

In the catalytic cracking of hydrocarbon feedstocks, particularly heavy feedstocks, nickel, vanadium and/or iron present in the feedstocks become deposited on the cracking catalyst promoting excessive hydrogen and coke makes. These metal contaminants are not removed by conventional catalyst regeneration operations, which convert coke deposits on the catalyst to CO and $CO_2$. As used hereinafter, the term "passivation" is defined as a method for decreasing the detrimental catalytic effects of metal contaminants such as nickel, vanadium and/or iron which become deposited on the cracking catalyst.

Several patents disclose the use of a reducing atmosphere to passivate cracking catalyst. U.S. Pat. No. 2,575,258 discloses the addition of a reducing agent to regenerated catalyst at a plurality of locations in the transfer line between the regeneration zone and the cracking zone for countercurrent flow of the reducing gas relative to the flow of the regenerated catalyst. This patent also discloses the addition of steam to the transfer line downstream of the points at which reducing gas is added to the transfer line to assist in moving regenerated catalyst from the regeneration zone to the reaction zone. Countercurrent flow for the reducing gas relative to the catalyst flow is not desirable, particularly at relatively high catalyst circulation rates, since the catalyst and reducing gas will tend to segregate into two oppositely flowing phases. This would result in poor catalyst contacting. Moreover, it is possible that bubbles of countercurrently flowing reducing gas intermittently could interrupt the recirculation of the catalyst.

International Patent Application (PCT) No. WO 82/04063 discloses in the processing of metal-contaminated hydrocarbons, the addition of reducing gas to a stripping zone disposed between the regeneration zone and the reaction zones to strip the catalyst. This patent also discloses the addition of reducing gas to a separate vessel and/or to the riser downstream of the flow control means to reduce at least a portion of the oxidized nickel contaminates present.

European Patent Publication No. 52,356 also discloses that metal contaminants can be passivated utilizing a reducing atmosphere at an elevated temperature. This publication discloses the use of reducing gases for passivating regenerated catalyst before the catalyst is returned to the reaction zone. This publication also discloses that the contact time of the reducing gas with the catalyst may range between 3 seconds and 2 hours, preferably between about 5 and 30 minutes. This patent publication further discloses that the degree of passivation is improved if antimony is added to the cracking catalyst.

U.S. Pat. No. 4,377,470 discloses a process for catalytic cracking of a hydrocarbon feed having a significant vanadium content. Reducing gas may be added to the regenerator and to the transfer line between the regenerator and the reactor to maintain the vanadium in a reduced oxidation state.

U.S. Pat. Nos. 4,280,859; 4,280,896; 4,370,220; 4,372,840; 4,372,841; and 4,409,093 disclose that cracking catalyst can be passivated by passing the catalyst through a passivation zone, having a reducing atmosphere maintained at an elevated temperature for a period of time ranging from 30 seconds to 30 minutes, typically from about 2 to 5 minutes.

U.S. Pat. Nos. 4,298,459 and 4,280,898 describe processes for cracking a metals-containing feedstock where the used cracking catalyst is subjected to alternate exposures of up to 30 minutes to an oxidizing zone and a reducing zone maintained at an elevated temperature to reduce the hydrogen and coke makes. These patents describe the use of a transfer line reaction zone disposed between a regeneration zone and a stripping zone. The U.S. Pat. No. 4,280,898 discloses that a metallic reactant, such as cadmium, zinc, sodium, scandium, titanium, chromium, molybdenum, manganese, cobalt, nickel antimony copper, the rare earth metals, and compounds of these metals may be added to adsorb the sulfur oxides produced.

U.S. Pat. No. 4,268,416 describes a method for passivating cracking catalyst in which metal contaminated cracking catalyst is contacted with a reducing gas at elevated temperatures to passivate the catalyst.

U.S. Pat. No. 3,408,286 discloses the addition of a liquid hydrocarbon to regenerated catalyst under cracking conditions in a transfer line before the regenerated catalyst is recharged to the cracking zone. The cracking of the liquid hydrocarbon prior to entering the cracking zone operates to displace entrained regenerator gases from the regenerated catalyst entering the cracking zone.

Several patents describe the addition of elements or compounds to passivate the adverse catalytic effects of iron, nickel and vanadium which may be present in the hydrocarbon feedstock.

U.S. Pat. No. 2,901,419 discloses the use of additives selected from groups III and IV of the Periodic Table, preferably from the right side sub-groups or from the right side sub-groups of groups I and II. Preferred compounds include copper, silver, gold, zinc, cadmium and mercury and compounds of these metals. Included in the specifically disclosed compounds were cadmium fluoride, cadmium formate, cadmium oxalate and cadmium oxide. The group III metals include indium, while the group IV metals include germanium.

PCT Patent Publications Nos. WO 82/03225 and WO 82/03226 disclose the use of the several metals, their oxides and salts, and their organometallic compounds to immobilize vanadium in a catalytic cracking operation. The metals include indium, tellurium, magnesium, calcium, strontium, barium, scandium, yttrium, lanthanum, titanium, zirconium, hafnium, niobium, tantalum, manganese, iron, thallium, bismuth, the rare earths and the Actinide and Lanthanide series of elements.

U.S. Pat. No. 4,386,015 discloses the use of germanium and germanium compounds to passivate metal contaminants in a catalytic cracking operation.

European Patent Application No. 38,047 discloses the use of germanium and germanium compounds for passivating metal.

U.S. Pat. No. 4,238,317 is directed at a method for decreasing the carbon monoxide and sulfur oxide emissions from a catalytic cracking system. A metallic oxidation promoter may be used to oxidize the carbon monoxide and sulfur oxides. The oxidation promoter may include cadmium, zinc, magnesium, strontium, barium, scandium, titanium, chromium, molybdenum, manganese, cobalt, nickel, antimony, copper, lead, the rare earth metals, and compounds thereof.

U.S. Pat. Nos. 4,208,302 and 4,256,564 disclose the use of indium and indium compounds for passivating the adverse catalytic effects of metal contaminants. The patents both indicate that the catalyst was aged prior to use by exposure to alternate high reducing and oxidizing cycles prior to use.

U.S. Pat. No. 4,257,919 discloses the use of indium, tin, bismuth, and compounds thereof for passivating metal contaminants.

U.S. Pat. Nos. 4,169,042 and 4,218,337 disclose the use of elemental tellurium, tellurium oxides, and compounds convertible to elemental tellurium, or tellurium oxide to passivate the adverse catalytic effects of metal contaminats.

The addition of reducing gas to the transfer line between the regeneration zone and the reaction zone would obviate the necessity for installing a separate passivation vessel in the cracking system. The use of the transfer line as a passivation zone would be of particular utility in existing cracking systems where space limitations would preclude the addition of a separate passivation vessel. However, the residence time of the cracking in the transfer line is rather limited.

It would, therefore, be advantageous to have a method for increasing the rate of passivation of the metal contaminants in the transfer line.

It also would be advantageous to have a method for passivating the metal contaminants on the cracking catalyst without the addition of a separate passivation vessel.

The present invention is directed at a method for increasing the rate of metal contaminant passivation in a passivation zone disposed in a cracking system by the addition to the cracking system of a passivation promoter. The passivation promoter preferably is selected from the group consisting of cadmium, germanium, indium, tellurium, zinc, and mixtures thereof.

SUMMARY OF THE INVENTION

The present invention is directed at a method for passivating cracking catalyst in a cracking system comprising a reaction zone, a regeneration zone, and a passivation zone, said method comprising:

A. passing feedstock containing a metal contaminant selected from the group consisting of nickel, vanadium, iron and mixtures thereof into the reaction zone maintained under reaction conditions having cracking catalyst therein, coke and metal contaminant becoming deposited on the cracking catalyst;

B. passing cracking catalyst from the reaction zone to the regeneration zone maintained under regeneration conditions wherein at least a portion of the coke is removed from the catalyst;

C. passing metal contaminated cracking catalyst from the regeneration zone through the passivation zone maintained under passivation conditions prior to returning the cracking catalyst to the reaction zone; and D. adding a passivation promoter to the cracking system, the passivation promoter selected from the group of metals consisting of cadmium, germanium, indium, tellurium, zinc, compounds thereof and mixtures thereof.

In a preferred embodiment the passivation zone is disposed at least partially in the transfer zone communicating with the regeneration zone and reaction zones. The temperature in the transfer zone preferably is maintained in the range of about 700° C. to about 850° C. The concentration of the passivation promoter in the system preferably is maintained between about 0.005 and about 0.20 weight percent of the cracking catalyst present in the cracking system, and more preferably within the range of about 0.025 and about 0.10 weight percent. Particularly preferred passivation promoters comprise germanium zinc, cadmium, and compounds thereof, with cadmium and cadmium compounds being most preferred. The residence time of the catalyst in the pasivation zone preferably is maintained between about 0.1 and about 20 minutes, more preferably between about 0.5 and about 2 minutes. Passivation promoter preferably is added to the feed or deposited on the catalyst, with the more preferred method comprising the addition of the promoter with the feed.

DETAILED DESCRIPTION OF THE INVENTION

Figure 1:
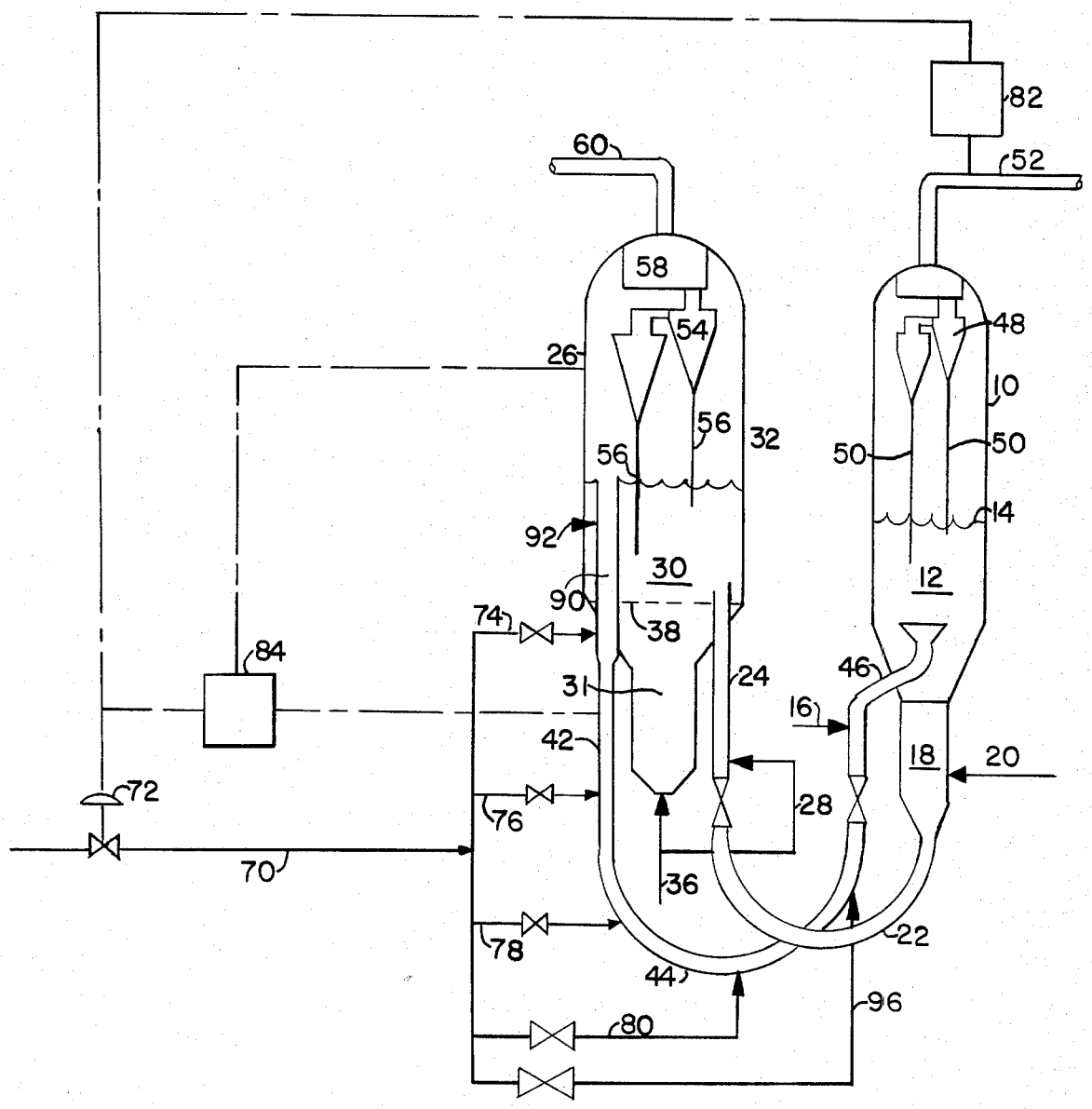
FIG. 1 is a simplified schematic drawing of one embodiment for practicing the subject invention.

Referring to FIG. 1, one method for practicing the subject invention is shown. In this drawing pipes, valves, instrumentation, etc. not essential to an understanding of the invention have been deleted for simplicity. Reaction or cracking zone 10 is shown containing a fluidized catalyst bed 12 having a level at 14 in which a hydrocarbon feedstock is introduced into the fluidized bed through line 16 for catalytic cracking. The hydrocarbon feedstock may comprise naphthas, light gas oils, heavy gas oils, residual fractions, reduced crude oils, cycle oils derived from any of these, as well as suitable fractions derived from shale oil, kerogen, tar sands, bitumen processing, synthetic oils, coal, hydrogenation, and the like. Such feedstocks may be employed singly, separately in parallel reaction zones, or in any desired combination. Typically, these feedstocks will contain metal contaminants such as nickel, vanadium and/or iron. Heavy feedstocks typically contain relatively high concentrations of vanadium and/or nickel. Hydrocarbon gas and vapors passing through fluidized bed 12 maintain the bed in a dense, turbulent, fluidized condition.

In reaction zone 10, the cracking catalyst becomes spent during contact with the hydrocarbon feedstock due to the deposition of coke thereon. Thus, the terms "spent" or "coke-contaminated" catalyst as used herein generally refer to catalyst which has passed through a reaction zone and which contains a sufficient quantity of coke thereon to cause activity loss, thereby requiring regeneration. Generally, the coke content of spent catalyst can vary anywhere from about 0.5 to about 5 wt.% or more. Typically, spent catalyst coke contents vary from about 0.5 to about 1.5 wt.%.

Prior to actual regeneration, the spent catalyst is usually passed from reaction zone 10 into a stripping zone 18 and contacted therein with a stripping gas, which is introduced into the lower portion of zone 18 via line 20. The stripping gas, which is usually introduced at a pressure of from about 10 to 50 psig, serves to remove most of the volatile hydrocarbons from the spent catalyst. A preferred stripping gas is steam, although nitrogen, other inert gases or flue gas may be employed. Normally, the stripping zone is maintained at essentially the same temperature as the reaction zone, i.e., from about 450° C. to about 600° C. Stripped spent catalyst from which most of the volatile hydrocarbons have been removed, is then passed from the bottom of stripping zone 18 through U-bend 22 and connecting vertical riser 24, which extends into the lower portion of a regeneration zone. Air is added to riser 24 via line 28 in an amount sufficient to reduce the density of the catalyst flowing therein, thus causing the catalyst to flow upwardly into regeneration zone 26 by simple hydraulic balance.

In the particular configuration shown, regeneration zone 26 is a separate vessel (arranged at approximately the same level as reaction zone 10) containing a dense phase catalyst bed 30 having a level indicated at 32, which is undergoing regeneration to burn-off coke deposits formed in the reaction zone during the cracking reaction, above which is a dilute catalyst phase 34. An oxygen-containing regeneration gas enters the lower portion of regeneration zone 26 via line 36 and passes up through a grid 38 in the dense phase catalyst bed 30, maintaining said bed in a turbulent fluidized condition similar to that present in reaction zone 10. Oxygen-containing regeneration gases which may be employed in the process of the present invention are those gases which contain molecular oxygen in admixture with a substantial portion of an inert diluent gas. Air is a particularly suitable regeneration gas. An additional gas which may be employed is air enriched with oxygen. Additionally, if desired, steam may be added to the dense phase bed along with the regeneration gas or separately therefrom to provide additional inert diluents and/or fluidization gas. Typically, the specific vapor velocity of the regeneration gas will be in the range of from about 0.8 to about 6.0 feet/sec., preferably from about 1.5 to about 4 feet/sec.

In regeneration zone 26, flue gases formed during regeneration of the spent catalyst pass from the dense phase catalyst bed 30 into the dilute catalyst phase 34 along with entrained catalyst particles. The catalyst particles are separated from the flue gas by a suitable gas-solid separation means 54 and returned to the dense phase catalyst bed 30 via diplegs 56. The substantially catalyst-free flue gas then passes into a plenum chamber 58 prior to discharge from the regeneration zone 26 through line 60. Where the regeneration zone is operated for substantially combustion of the coke, the flue gas typically will contain less than about 0.2, preferably less than 0.1 and more preferably less than 0.05 volume % carbon monoxide. The oxygen content usually will vary from about 0.4 to about 7 vol.%, preferably from about 0.8 to about 5 vol.%, more preferably from about 1 to about 3 vol.%, most preferably from about 1.0 to about 2 vol.%.

Regenerated catalyst exiting from regeneration zone 26 preferably has had a substantial portion of the coke removed. Typically, the carbon content of the regenerated catalyst will range from about 0.01 to about 0.6 wt.%, preferably from about 0.01 to about 0.1 wt.%. The regenerated catalyst from the dense phase catalyst bed 30 in regeneration zone 26 flows through a transfer zone comprising standpipe 42 and U-bend 44 to reaction zone 10.

In FIG. 1 passivation zone 90 extends for substantially the entire length of standpipe 42 and U-bend 44 to gain substantially the maximum possible residence time. If a shorter residence time is desired, passivation zone 90 could comprise only a fraction of the length of standpipe 42 and/or U-bend 44. Conversely, if a greater residence time were desired, the crosssectional area of standpipe 42 and/or U-bend 44 could be increased. Stripping gas streams, optionally may be added at the inlet of passivation zone 90 to minimize the intermixing of regeneration zone gas with the passivation zone reducing gas. The stripping gas may be any non-oxidizing gas, such as steam, which will not adversely affect the passivated catalyst and which will not hinder the processing of the feedstock in the reaction zone. In this embodiment, line 92 is disposed upstream of passivation zone 90, to minimize intermixing of the reducing atmosphere in passivation zone 90 with the gas stream for regeneration zone 26 by stripping out entrained oxygen from the regenerated catalyst.

Since the catalyst residence time in standpipe 42 and U-bend 44 typically may range only from about 0.1 to about 2 minutes, it may be necessary to increase the rate at which the metal contaminant present on the cracking catalyst is passivated. It has been found that the addition of passivation promoters selected from the group consisting of cadmium, germanium, indium, tellurium, zinc, compounds thereof and mixtures thereof increases the rate of passivation of the metal contaminants, particularly where the residence time of the cracking catalyst in a passivation zone is less than about 5 minutes. Often it may be advantageous to maximize the effectiveness of the catalyst residence time in passivation zone 90 by injecting increasing quantities of reducing gas into the passivation zone until the additional reducing gas ceases to produce benefits in the cracking process. This may occur if the addition of reducing gas adversely affects the catalyst flow rate through the passivation zone. This also may occur when the incremental increase in the rate of reducing gas addition to the passivation zone does not result in a corresponding decrease in the hydrogen and/or coke make in reaction zone 10. In FIG. 1, the reducing gas flow rate through line 70 is regulated by a control means, such as control valve 72. Reducing gas passing through control valve 72 in line 70 subsequently passes through a plurality of lines such as 74, 76, 78 and 80 and 96 to distribute the reducing gas into passivation zone 90. Control valve 72 is shown being regulated by a cracked product monitoring means, such as analyzer 82. Analyzer 82 may be adapted to monitor the content of one or more products in stream 52. Since the hydrogen content of the cracked product is a function of the degree of catalyst metals passivation, in a preferred embodiment, analyzer 82 may be a hydrogen analyzer. Alternatively, since the rate of coke production also is a function of the degree of catalyst metals passivation, the rate of reducing gas addition also could be regulated by monitoring the rate of coke production. This may be accomplished by monitoring the heat balance around reaction zone 10 and/or regeneration zone 26.

The rate of addition of reducing gas to passivation zone 90 also must be maintained below the point at which it will cause a significant fluctuation in the catalyst circulation rate. In the embodiment shown in FIG. 1, the rate of catalyst circulation through passivation zone 90 may be monitored by a sensing means, such as sensor 84, shown communicating with regeneration zone 26, standpipe 42 and control valve 72.

In the commercial operation of this embodiment, the concentration of hydrogen in product stream 52 may be monitored by analyzer 82, which adjusts the rate of addition of reducing gas through control valve 72 to minimize the hydrogen content in stream 52. Sensor 84 operates as a limit on control valve 72, by decreasing the rate of addition of reducing gas to passivation zone 90, when the rate of addition of reducing gas begins to adversely affect the catalyst circulation rate.

Figure 2:
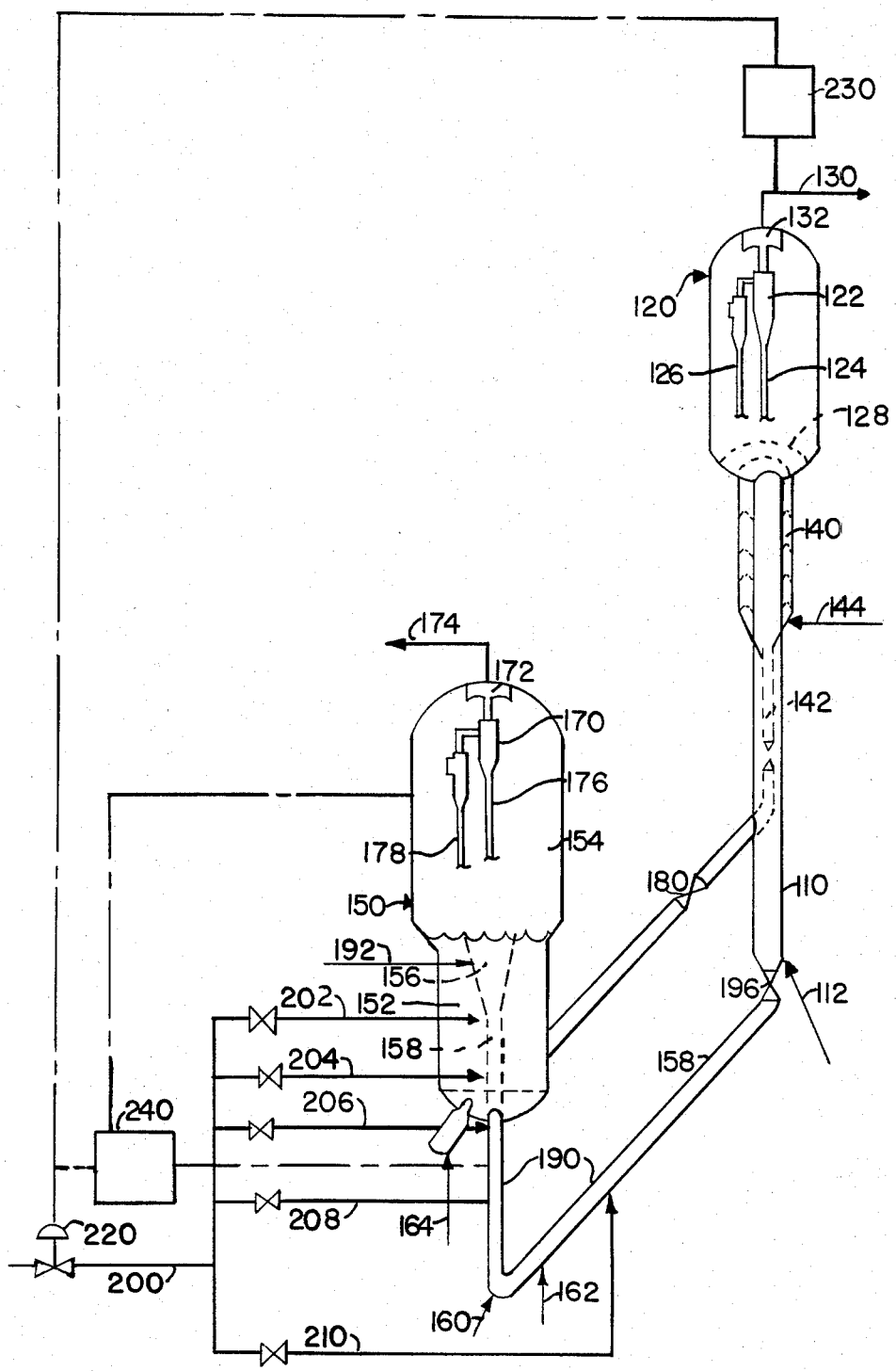
FIG. 2 is a simplified schematic drawing of an alternate embodiment for practicing the subject invention.

Referring to FIG. 2, an alternate embodiment for practicing the subject invention is disclosed. The operation of this embodiment is generally similar to that previously described in FIG. 1. In this embodiment, riser reaction zone 110 comprises a tubular, vertically extending vessel having a relatively large height in relation to its diameter. Reaction zone 110 communicates with a disengagement zone 120, shown located a substantial height above regeneration zone 150. The catalyst circulation rate is controlled by a valve means, such as slide valve 180, located in spent catalyst transfer line 140, extending between disengagement zone 120 and regeneration zone 150. In this embodiment, hydrocarbon feedstock is injected through line 112 riser reaction zone 110 having a fluidized bed of catalyst to catalytically crack the feedstock. Steam may be injected through lines 160 and 162 in a second transfer zone, such as return line 158, extending between regeneration zone 150 and reaction zone 110 to serve as a diluent, to provide a motive force for moving the hydrocarbon feed-stock upwardly and for keeping the catalyst in a fluidized condition.

The vaporized, cracked feedstock products pass upwardly into disengagement zone 120 where a substantial portion of the entrained catalyst is separated. The gaseous stream then passes through a gas-solid separation means, such as two stage cyclone 122, which further separates out entrained catalyst and returns it to the disengagement zone through diplegs 124, 126. The gaseous stream passes into plenum chamber 132 and exits through line 130 for further processing (not shown). The upwardly moving catalyst in reaction zone 110 gradually becomes coated with carbonaceous material which decreases its catalytic activity. When the catalyst reaches the top of reaction zone 110 it is redirected by grid 128 into stripping zone 140 in spent catalyst transfer line 142 where it is contacted by a stripping gas, such as steam, entering through line 144 to partially remove the remaining volatile hydrocarbons from the spent catalyst. The spent catalyst then passes through spent catalyst transfer line 142 into dense phase catalyst bed 152 of regeneration zone 150. Oxygen containing regeneration gas enters dense phase catalyst bed 152 through line 164 to maintain the bed in a turbulent fluidized condition, similar to that in riser reaction zone 110. Regenerated catalyst gradually moves upwardly through dense phase catalyst bed 152 eventually flowing into overflow well 156 communicating with return line 158. Return line 158 is shown exiting through the center of dense phase catalyst bed 152, and communicating with riser reaction zone 110.

Flue gas formed during the regeneration of the spent catalyst passes for the dense phase catalyst bed 152 into dilute catalyst phase 154. The flue gas then passes through cyclone 170 plenum chamber 172 prior to discharge through line 174. Catalyst entrained in the flue gas is removed by cyclone 170 and is returned to catalyst bed 152 through diplegs 176, 178.

As previously indicated for the embodiment of FIG. 1, a passivation zone, such as passivation zone 190, may be disposed in or may comprise substantially all of overflow well 156 and/or return line 158. If passivation zone 190 comprises substantially all of return line 158, the fluidizing gas injected through lines 160 and 162 may comprise reducing gas. To avoid excess reducing gas consumption while providing sufficient quantities of gas to adequately fluidize the regenerated particles in line 158, it may be desirable to dilute the reducing gas with steam and/or other diluent gas added through lines 160 and 162. The residence time of catalyst in overflow well 156 and return line 158 typically ranges between about 0.1 and about 1 minute. Here also it may be necessary to increase the rate at which metal contaminant on the catalyst is passivated. As shown for the embodiment of FIG. 1, it may be desirable to add a stripping gas, such as steam through line 192 to overflow well 156 to remove entrained oxygen from the regenerated catalyst.

The reducing gas preferably is added to passivation zone 190 at a plurality of locations through branched lines, such as lines 202, 204, 206, 208, and 210 extending from reducing gas header 200. As previously described in FIG. 1, a control means, such as control valve 220 is disposed in reducing gas header 200 to regulate the rate of addition of reducing gas to passivation zone 190. A cracked product monitoring means, such as analyzer 230 is shown communicating with cracked product line 130 and with control valve 220 to maintain the sampled cracked product component within the desired limits by regulation of the rate of addition of reducing gas to passivation zone 190. Since hydrogen is one of the products produced by the adverse catalytic properties of the metal contaminants, hydrogen may be the preferred component to be regulated. Since the metal contaminant also catalyzes the formation of coke, the rate of reducing gas addition also could be regulated by the monitoring of the rate of coke production, such as by monitoring the heat balance around regeneration zone 150, as previously described. As in the embodiment of FIG. 1, the rate of catalyst circulation may be monitored by a sensing means, such as sensor 240, communicating with valve 220, to control the maximum rate of addition of reducing gas to passivation zone 190. The commercial operation of this embodiment would be substantially similar to that previously described for the embodiment of FIG. 1. A component in the product stream, such as hydrogen, is monitored by analyzer 230, which directs control valve 220 to adjust the rate of addition of reducing gas to passivation zone 190, such as to minimize the hydrogen content in stream 130. Sensor 240 monitors the catalyst circulation rate and operates as an over-ride on control valve 220, to reduce the rate of addition of reducing gas if the reducing gas has, or is about to have, an adverse effect on the catalyst circulation rate.

The metals concentration deposited on the catalyst is not believed to differ significantly whether the embodiment of FIG. 1 or the embodiment of FIG. 2 is used. Thus, the amount of reducing gas which is consumed in passivation zones 90, 190 of the embodiments of FIGS. 1, 2, respectively, and the amount of passivation promoter which is added should not differ greatly. Since the catalyst must be fluidized in the embodiment of FIG. 2, and need not be fluidized in the embodiment of FIG. 1, it is more likely that, in practicing the embodiment of FIG. 2, a diluent gas will be added with reducing gas to passivation zone 190 to fluidize the catalyst.

The rate of addition of the passivation promoter will be a function, in part, of the residence time of the cracking catalyst in the passivation zone, the particular passivation promoter utilized, the metals level on the catalyst, the desired degree of passivation and the passivation zone temperature. Typically, the passivation promoter concentration may range between about 0.005 and about 0.20 weight percent of the catalyst present in the cracking system and preferably between about 0.025 and about 0.10 weight percent of the cracking catalyst present.

While the reducing gas consumption rate in passivation zones 90, 190, of FIGS. 1, 2, respectively, will be a function, in part, of the metal contaminant levels on the catalyst, the desired degree of passivation and the amount of reducing gas infiltration into the regeneration zone, it is believed that the overall rate of consumption of the reducing gas will range from about 0.5 to about 260 SCF, preferably from about 1 to about 110 SCF, for each ton of catalyst passed through passivation zones 90, 190 if hydrogen is used as the reducing gas.

In the embodiments of FIG. 1 or 2, it is believed that the combustion of coke in regeneration zones 26 or 150, respectively, will heat sufficiently the cracking catalyst subsequently passed through passivation zones 90, 190, respectively. The required temperature in passivation zones 90, 190 will be a function of the desired degree of passivation, the particular passivation promoter utilized and the passivation zone residence time. If the temperature of the catalyst entering passivation zones 90 or 190 is not sufficiently high, additional heat may be added to the passivation zone either directly, such as by the preheating of the reducing gas, or by adding steam, or indirectly, such as by the addition of a heat exchange means prior to, or within the passivation zone.

Reaction zones 10, 110 and regeneration zones 26, 150, of FIGS. 1, 2, respectively, may be of conventional design and may be operated at conditions well-known to those skilled in the art. Regeneration zones 26, 150 may be operated in either a net oxidizing or a net reducing mode. In a net oxidizing mode, oxidizing gas in excess of that required to completely combust the coke to $CO_2$ is added to the regeneration zone. In a net reducing mode insufficient oxidizing gas is added to completely combust the coke to $CO_2$. Regeneration zones 26 and 150 preferably should be operated in a net reducing mode, since carbon monoxide is a reducing gas which will help decrease the adverse catalytic properties of the metal contaminants on the catalyst prior to the catalyst entering passivation zones 90, 190.

The required residence time of the catalyst in the passivation zone may be dependent upon many factors, including the metal contaminant content of the catalyst, the degree of passivation required, the concentration of reducing gas in the passivation zone, and the passivation zone temperature. The present invention is of particular utility where the passivation zone residence time is limited, such as where the passivation zone is disposed in the transfer zone communicating with the regeneration zone and reaction zone as shown in FIGS. 1 and 2. It is to be understood, however, that the present invention may be utilized where the passivation zone is not located in the transfer line.

The utility of the present invention may be seen from the following examples in which the effectiveness of cadmium, germanium, indium, tellurium, and zinc is demonstrated, particularly when combined with the use of a passivation zone having a relatively short residence time.

Samples of previously used Super-DX cracking catalyst, a silica alumina catalyst manufactured by Davison Chemical Company, a division of W. R. Grace and Company, was impregnated with 1000 wppm nickel and 4000 wppm vanadium. Samples were passivated at 704° C. without the addition of any passivation promoter. The Gas Producing Factor (GPF), a direct measure of the metal contaminant activity, obtained by a microactivity test (MAT) as described in ASTM D3907-80, was measured with samples having differing passivation zone residence times. The results are shown in Table I. The GPF is described in detail, by Earl C. Gossett, "When Metals Poison Cracking Catalyst", *Petroleum Refiner,* Vol. 39, No. 6, June 1980, pp. 177–180, the disclosure of which is incorporated herein by reference.

TABLE I

EFFECT OF HYDROGEN PASSIVATION ON CRACKING CATALYST ACTIVITY

| Catalyst Residence Time in Hydrogen Passivation Zone (min) | Gas Producing Factor (GPF) | Degree of Passivation ($GPF/GPF_o$) |
|---|---|---|
| 0 | 19.0 ($GPF_o$) | 1.0 |
| 5 | 15.6 | 0.82 |
| 8 | 13.9 | 0.73 |
| 10 | 12.9 | 0.68 |
| 20 | 9.5 | 0.50 |
| 40 | 7.5 | 0.39 |
| 60 | 6.5 | 0.34 |
| 90 | 5.8 | 0.31 |
| 2 hr | 5.5 | 0.29 |
| 3 hr | 5.3 | 0.28 |
| 4 hr | 5.0 | 0.26 |

Separate samples of this same metal contaminant-impregnated Super-DX catalyst were impregnated with 2000 wppm of cadmium, germanium, indium, tellurium and zinc. These results are reported in Tables II, III, IV, V and VI, respectively.

EXAMPLE I

Samples of the Super-DX metal contaminated cracking catalyst having 2000 wppm of each of the above-noted passivation promoters were placed in a passivation zone maintained at 704° C. for varying residence times after which the GPF of the passivated catalysts was determined. Tables II, III, IV, V and VI present the gas producing factors and degree of passivation for the passivated catalyst samples impregnated with cadmium, germanium, indium, tellurium, and zinc, respectively. Tables II–VI also present the GPF predicted from the additive effect of hydrogen passivation and the use of passivation promoters. The degree of passivation from Table I was used to estimate the passivation achieved by hydrogen alone. The GPF for the promoted samples without hydrogen passivation denoted as $GPF_o$ was used to estimate the individual contribution from the passivation promoter alone. The predicted combination of these effects for metal passivation was calculated as follows: GPF predicted=(Individual effect of hydrogen passivation at each residence time)+(GPF for promoted sample with no hydrogen passivation). The degree of passivation attributable to hydrogen passivation at each residence time is $$\left(\frac{GPF}{GPF_{o,base}}\right)_{at\ residence\ time} \cdot (GPF_{o,base})$$

The degree of passivation attributable to the passivation promoter is $$\left(1 - \frac{GPF_{o\ additive}}{GPF_{obase}}\right) \cdot (GPF_{pass})$$

where $GPF_{obase}$=GPF with no hydrogen passivation and no passivation promoter $GPF_{o,\ additive}$=GPF with no hydrogen passivation, but with the passivation promoter present $GPF_{pass}$=GPF measured for hydrogen passivation at indicated time with no passivation promoter present As may be seen from Tables II–VI, at short passivation zone residence times, i.e., less than about 10 minutes, when each of the passivation promoted catalyst samples is passivated, the reduction in the gas producing factors is greater than the additive effect for the individual reductions in the gas producing factor for hydrogen passivation at a given passivation zone residence time and temperature, and the effect of the metal passivation additive.

TABLE II

CRACKING CATALYST IMPREGNATED WITH 2000 WPPM CADMIUM

| Cracking Catalyst Residence Time in Hydrogen Passivation Zone (min) | Measured Gas Producing Factor (GPF Meas) | $GPF/GPF_o$ | GPF Predicted | Δ (Meas. − Pred.) |
|---|---|---|---|---|
| 0 | 18.3 ($GPF_o$) | 1.0 | 18.3 | 0 |
| 5 | 12.1 | 0.66 | 15.0 | −2.9 |
| 8 | 8.5 | 0.46 | 13.4 | −4.9 |
| 10 | 8.1 | 0.44 | 12.4 | −4.3 |
| 20 | 5.5 | 0.30 | 9.1 | −3.7 |
| 40 | 5.4 | 0.30 | 7.1 | −1.7 |
| 90 | 4.8 | 0.26 | 5.7 | −0.9 |
| 180 | 3.9 | 0.21 | 5.1 | −1.2 |

TABLE III

CRACKING CATALYST IMPREGNATED WITH 2000 WPPM ZINC

| Cracking Catalyst Residence Time in Hydrogen Passivation Zone (min) | Measured Gas Producing Factor (GPF Meas) | $GPF/GPF_o$ | GPF Predicted | Δ (Meas. − Pred.) |
|---|---|---|---|---|
| 0 | 18.5 ($GPF_o$) | 1.0 | — | — |
| 5 | 12.8 | 0.69 | 15.2 | −2.4 |
| 10 | 10.5 | 0.57 | 12.6 | −2.1 |
| 20 | 8.3 | 0.45 | 9.3 | −1.0 |
| 40 | 9.2 | 0.50 | 7.2 | +2.0 |
| 90 | 6.2 | 0.34 | 5.7 | +0.5 |
| 180 | 6.0 | 0.32 | 5.2 | +0.8 |

TABLE IV

CRACKING CATALYST IMPREGNATED WITH 2000 WPPM INDIUM

| Cracking Catalyst Residence Time in Hydrogen Passivation Zone (min) | Measured Gas Producing Factor (GPF Meas) | $GPF/GPF_o$ | GPF Predicted | Δ (Meas. − Pred.) |
|---|---|---|---|---|
| 0 | 16.4 ($GPF_o$) | 1.0 | — | — |
| 5 | 11.6 | 0.71 | 13.4 | −1.8 |
| 8 | 10.4 | 0.63 | 12.0 | −1.6 |
| 10 | 9.3 | 0.57 | 11.2 | −1.9 |
| 20 | 7.8 | 0.48 | 8.2 | −0.4 |
| 40 | 8.3 | 0.51 | 6.4 | +1.9 |
| 60 | 4.9 | 0.30 | 5.6 | −0.7 |
| 120 | 4.0 | 0.24 | 4.8 | −0.8 |

TABLE V

CRACKING CATALYST IMPREGNATED WITH 2000 WPPM GERMANIUM

| Cracking Catalyst Residence Time in Hydrogen Passivation Zone (min) | Measured Gas Producing Factor (GPF Meas) | $GPF/GPF_o$ | GPF Predicted | Δ (Meas. − Pred) |
|---|---|---|---|---|
| 0 | 15.3 ($GPF_o$) | 1.0 | — | — |
| 5 | 9.8 | 0.64 | 12.5 | −2.7 |
| 10 | 8.8 | 0.58 | 10.4 | −1.6 |
| 20 | 8.3 | 0.54 | 7.7 | +0.6 |

TABLE V-continued

| CRACKING CATALYST IMPREGNATED WITH 2000 WPPM GERMANIUM | | | | |
|---|---|---|---|---|
| Cracking Catalyst Residence Time in Hydrogen Passivation Zone (min) | Measured Gas Producing Factor (GPF Meas) | $GPF/GPF_o$ | GPF Predicted | Δ (Meas. − Pred) |
| 40 | 6.2 | 0.41 | 6.0 | +0.2 |
| 90 | 5.0 | 0.33 | 4.7 | +0.3 |
| 180 | 4.8 | 0.31 | 4.3 | +0.5 |

TABLE VI

| CRACKING CATALYST IMPREGNATED WITH 2000 WPPM TELLURIUM | | | | |
|---|---|---|---|---|
| Cracking Catalyst Residence Time in Hydrogen Passivation Zone (min) | Measured Gas Producing Factor (GPF Meas) | $GPF/GPF_o$ | GPF Predicted | Δ (Meas. − Pred.) |
| 0 | 16.6 ($GPF_o$) | 1.0 | — | — |
| 5 | 12.1 | 0.73 | 13.6 | −1.5 |
| 8 | 9.4 | 0.57 | 12.1 | −2.7 |
| 10 | 9.2 | 0.55 | 11.3 | −2.1 |
| 40 | 9.4 | 0.57 | 6.5 | +2.9 |
| 90 | 7.8 | 0.47 | 5.1 | +2.7 |
| 180 | 6.9 | 0.42 | 4.6 | +2.3 |

Another sample of Super-DX metal contaminated cracking catalyst having 1000 wppm Ni and 4000 wppm V was passivated at 704° C. without the addition of any passivation promoter. This catalyst exhibited higher metal contaminant activity as compared with that used in the previous tests. The Gas Producing Factor again was measured at different passivation zone residence times to measure the metal contaminant activity. The results are shown in Table VII.

EXAMPLE II

A sample of this second Super-DX metal contaminated catalyst was impregnated with only 250 wppm of cadmium. The catalyst sample was passivated for varying residence times, after which the GPF of the passivated sample was measured. The results are also presented in Table VII. As may be seen from Table VII, at short passivation zone residence times, i.e., less than about 30 minutes, the reduction in the Gas Producing Factor for the passivation promoted sample is greater than the additive effect for the individual reductions in the GPF for hydrogen passivation at a given passivation zone residence time and temperature and the metals passivation additive.

TABLE VII

| CRACKING CATALYST IMPREGNATED WITH 250 WPPM CADMIUM | | | | | | |
|---|---|---|---|---|---|---|
| Cracking Catalyst | Base (no Cadmium) | | | | | |
| Residence Time in Hydrogen Passivation Zone (min) | Measured Gas Producing Factor (GPF Meas) | $GPF/GPF_o$ | Catalyst With 250 wppm Cadmium GPF Meas | $GPF/GPF_o$ | GPF Predicted | Δ (Meas. − Pred.) |
| 0 | 26.9 ($GPF_o$) | 1.0 | 28.9 ($GPF_o$) | 1.0 | — | — |
| 5 | 25.1 | .93 | 24.0 | .83 | 26.9 | −2.9 |
| 10 | 18.4 | .68 | 13.1 | .45 | 19.7 | −6.6 |
| 30 | 16.0 | .61 | 8.8 | .31 | 17.6 | −8.8 |
| 60 | 8.9 | .33 | 6.7 | .23 | 9.5 | −2.8 |

Thus, Tables I—VII demonstrate that the present invention is of particular utility in situations where the passivation zone residence time is relatively short, such as when a transfer line passivation zone is utilized.

Tables VIII and IX demonstrate that the unexpected reduction in the Gas Producing Factor may be affected by the passivation zone temperature.

A third sample of Super-DX metal contaminated cracking catalyst having 800 wppm NI and 2400 wppm V was placed in a passivation zone for varying times at 593° C. and 649° C. to determine the GPF at different passivation zone residence times.

EXAMPLE III

These catalyst samples also were impregnated with 1000 wppm cadmium and the tests repeated. From Table VII it may be seen that the unexpected reduction in the GPF shown in Table II for cadmium at 704° C. not realized at 593° C., or 649° C. This illustrates that, at short residence times, it may be necessary to maintain the passivation zone above a predetermined temperature for effective metals passivation.

TABLE VIII

| CRACKING CATALYST IMPREGNATED WITH 1000 WPPM CADMIUM; PASSIVATION ZONE TEMPERATURE 593° C. | | |
|---|---|---|
| Cracking Catalyst Residence Time in Hydrogen Passivation Zone (min) | No Cadmium Measured Gas Producing Factor (GPF Meas) | 1000 wppm Cadmium Measured Gas Producing Factor (GPF Meas) |
| 0 | 14.7 | 15.9 |
| 5 | 11.8 | 14.6 |
| 10 | 12.3 | 15.8 |
| 30 | 11.5 | 15.7 |
| 60 | 11.2 | 15.1 |

TABLE IX

CRACKING CATALYST IMPREGNATED WITH 1000 WPPM CADMIUM; PASSIVATION TEMPERATURE 649° C.

| Cracking Catalyst Residence Time in Hydrogen Passivation Zone (min) | No Cadmium Measured Gas Producing Factor (GPF Meas) | 1000 wppm Cadmium Measured Gas Producing Factor (GPF Meas) |
|---|---|---|
| 0 | 14.7 | 14.8 |
| 5 | 13.1 | 15.6 |
| 10 | 12.2 | 15.2 |
| 30 | 10.6 | 12.4 |
| 60 | 8.5 | 10.1 |

The passivation promoters may be added to the cracking system or impregnated onto the cracking catalyst in elemental form or as a compound which may decompose to deposit the passivation promoter on the catalyst.

Among the preferred cadmium, germanium, indium, tellurium and zinc compounds are metal organic, organic or inorganic complex salts, with metal organic oil soluble compounds being particularly preferred. The particular passivation promoter which is utilized will be dependent on many factors, including availability, process economics, corrosion, and desired degree of passivation. Particularly preferred passivation promoters include cadmium, germanium, zinc and compounds thereof, with cadmium and compounds thereof being especially preferred.

From the data presented above, it can be seen that the combination of reducing gas passivation at elevated temperature and the use of the previously enumerated passivation promoters was more effective than either treatment alone, particularly at passivation zone residence times of about 5 minutes or less, which would be greater than typical residence times for cracking catalyst in a transfer line passivation zone. The combination of the use of one or more passivation promoters and the reducing zone operated at elevated temperature to passivate metal contaminants present on cracking catalyst is of particular utility where the passivation zone is disposed in the transfer zone, such as passivation zones 90, 190 of FIGS. 1 and 2, respectively.

The amount of passivation promoter which is utilized will be dependent on several factors, including the particular promoter utilized, the metal contaminant content on the catalyst, the desired degree of passivation, the average catalyst residence time in the passivation zone, and the conditions in the passivation zone. The amount of passivation promoter which is used typically will range between about 0.005 and about 0.20 weight percent of the catalyst, preferably between about 0.025 and about 0.10 weight percent of the catalyst.

The method by which the passivation promoter is added to the catalyst is not believed to be critical. The passivation promoter may be impregnated directly into the catalyst before use, or it may be added to the cracking system during operation. To maintain the desired degree of passivation, a preferred method is to add the passivation promoter directly to the cracking system, preferably by adding a slip stream of the passivation promoter in a suitable carrier to the reaction zone.

In a typical commercial cracking system such as that shown in FIG. 1 catalyst residence time in the transfer zone, comprising standpipe 42 and U-bend 44, typically is about 0.1 to about 2 minutes. Similarly, for a typical commercial cracking system similar to that shown in FIG. 2, average catalyst residence time in transfer zone 190 typically ranges between about 0.1 and about 1.0 minutes. Thus, the transfer zones of FIGS. 1 and 2 typically have sufficient residence time to passivate catalyst upon the introduction of reducing gas.

The reducing agent utilized in the passivation zone is not critical. It is believed that commercial grade CO and process gas streams containing $H_2$ and/or CO can be utilized. Hydrogen or a reducing gas stream comprising hydrogen is preferred, since this achieves the highest rate of metals passivation and the lowest level of metal contaminant potency. Preferred reducing gas streams containing hydrogen include catalytic cracker tail gas streams, reformer tail gas streams, spent hydrogen streams from catalytic hydroprocessing, synthesis gas, steam cracker gas, flue gas, and mixtures thereof. The reducing gas content in the passivation zone should be maintained between about 2% and about 100%, preferably between about 10% and about 75% of the total gas composition depending upon the hydrogen content of the reducing gas and the rate at which the reducing gas can be added without adversely affecting the catalyst circulation rate.

The stripping gas, if any, added through line 92 of FIG. 1 and line 192 of FIG. 2 will be a function in part of catalyst flow rate. Typically, the stripping gas flow rates through each of these lines may range between about 0.1 SCF and about 80 SCF, preferably between about 8 and about 25 SCFM per ton of catalyst circulated.

Passivation zones 90, 190 may be constructed of any chemically resistant material capable of withstanding the relatively high temperature and the erosive conditions commonly associated with the circulation of cracking catalyst. The materials of construction presently used for transfer piping in catalytic cracking systems should prove satisfactory.

The pressure in passivation zones 90, 190, of FIGS. 1, 2, respectively, will be substantially similar to or only slightly higher than the pressures in the regenerated catalyst transfer zones of existing catalytic cracking systems. When the embodiment of FIG. 1 is used, the pressure in passivation zone 90 may range from about 5 to about 100 psig, preferably from about 15 to about 50. When the embodiment of FIG. 2 is used the pressure may range from about 15 psig to about 100 psig, preferably from about 20 psig to about 50 psig.

In general, any commercial catalytic cracking catalyst designed for high thermal stability could be suitably employed in the present invention. Such catalysts include those containing silica and/or alumina. Catalysts containing combustion promoters such as platinum also can be used. Other refractory metal oxides such as magnesia or zirconia may be employed and are limited only by their ability to be effectively regenerated under the selected conditions. With particular regard to catalytic cracking, preferred catalysts include the combinations of silica and alumina, containing 10 to 50 wt.% alumina, and particularly their admixtures with molecular sieves or crystalline aluminosilicates. Suitable molecular alumino-silicate materials, such as faujasite, chabazite, X-type and Y-type aluminosilicate materials and ultra stable, large pore crystalline aluminosilicate materials. When admixed with, for example, silica-alumina to provide a petroleum cracking catalyst, the molecular sieve content of the fresh finished catalyst particles is suitably within the range from 5–35 wt.%, preferably 8–20 wt.%. An equilibrium molecular sieve cracking catalyst may contain as little as about 1 wt.% crystalline material. Admixtures of clay-extended aluminas may also be employed. Such catalysts may be prepared by any suitable method such as by impregnation, milling, co-gelling, and the like, subject only to the provision that the finished catalysts be in a physical form capable of fluidization.

What is claimed is:

1. A method for passivating cracking catalyst in a cracking system comprising a reaction zone, a regeneration zone, and a passivation zone, said method comprising:

(a) passing feedstock containing a metal contaminant selected from the group consisting of nickel, vanadium, iron and mixtures thereof into the reaction zone maintained under reaction conditions having cracking catalyst therein, coke and metal contaminant becoming deposited on the cracking catalyst;

(b) passing cracking catalyst from the reaction zone to the regeneration zone maintained under regeneration conditions wherein at least a portion of the coke is removed from the catalyst;

(c) passing metal contaminated cracking catalyst from the regeneration zone through the passivation zone maintained under reducing conditions prior to returning the cracking catalyst to the reaction zone; and, (d) adding a passivation promoter to the cracking system, the passivation promoter selected from the group of metals consisting of cadmium, germanium, indium, tellurium, zinc, compounds thereof and mixtures thereof.

2. The method of claim 1 wherein the cracking system further comprises a transfer zone communicating with the regeneration zone and the reaction zone, and wherein the passivation zone is at least partially disposed in the transfer zone.

3. The method of claim 2 wherein reducing gas is added to the passivation zone.

4. The method of claim 3 wherein the temperature of the passivation zone is maintained above about 700° C.

5. The method of claim 4 wherein the temperature in the passivation zone is maintained within the range of about 700° C. to about 850° C.

6. The method of claim 3 wherein the concentration of the passivation promoter in the cracking system ranges between about 0.005 and about 0.20 weight percent of the cracking catalyst present.

7. The method of claim 6 wherein the concentration of the passivation promoter in the cracking system ranges between about 0.025 and about 0.10 weight percent of the cracking catalyst present.

8. The method of claim 6 wherein the passivation promoter is selected from the group consisting of cadmium and cadmium containing compounds.

9. The method of claim 6 wherein the passivation promoter is selected from the group consisting of germanium and germanium containing compounds.

10. The method of claim 6 wherein the passivation promoter is selected from the group consisting of indium and indium containing compounds.

11. The method of claim 6 wherein the passivation promoter is selected from the group consisting of tellurium and tellurium containing compounds.

12. The method of claim 6 wherein the passivation promoter is selected from the group consisting of zinc and zinc containing compounds.

13. The method of claim 6 wherein the average residence time of the cracking catalyst in the passivation zone ranges between about 0.1 and about 20 minutes.

14. The method of claim 13 wherein the average residence time of the cracking catalyst in the passivation zone ranges between about 0.5 and about 2 minutes.

15. The method of claim 14 wherein passivation promoter is added to the hydrocarbon feed to the reaction zone.

16. The method of claim 14 wherein passivation promoter is impregnated onto the catalyst prior to its introduction to the cracking system.

17. A method for passivating cracking catalyst in a cracking system comprising a reaction zone, a regeneration zone, and a passivation zone, said method comprising:

(a) passing feedstock containing a metal contaminant selected from the group consisting of nickel, vanadium, iron and mixtures thereof into the reaction zone maintained under reaction conditions having cracking catalyst therein, coke and metal contaminant becoming deposited on the cracking catalyst;

(b) passing cracking catalyst from the reaction zone to the regeneration zone maintained under regeneration conditions wherein at least a portion of the coke is removed from the catalyst;

(c) passing metal contaminated cracking catalyst from the regeneration zone through the passivation zone maintained under reducing conditions at a temperature above about 700° C. prior to returning the cracking catalyst to the reaction zone; and (d) adding a slip stream comprising an effective amount of a passivation promoter to the reaction zone, the passivation promoter selected from the group of metals consisting of cadmium, germanium, indium, tellurium, zinc, compounds thereof and mixtures thereof, the passivation promoter becoming deposited on the cracking catalyst facilitating passivation of the metal contaminant in the passivation zone.

* * * * *